United States Patent [19]

Montgomery

[11] Patent Number: 4,542,591

[45] Date of Patent: Sep. 24, 1985

[54] BOW SIGHT

[76] Inventor: Glenn Montgomery, Rte. 8, Box 285, Maryville, Tenn. 37801

[21] Appl. No.: 627,417

[22] Filed: Jul. 3, 1984

[51] Int. Cl.[4] ..... F41G 1/46

[52] U.S. Cl. ..... 33/265; 124/87

[58] Field of Search ..... 33/265; 124/87, 88

[56] References Cited

U.S. PATENT DOCUMENTS

| | | | |
|---|---|---|---|
| 2,332,080 | 10/1943 | Howe | 33/265 |
| 2,767,472 | 10/1956 | Kocur | 33/265 |
| 3,871,105 | 3/1975 | Brougham | 33/265 |
| 4,136,462 | 1/1979 | Topel | 33/265 |
| 4,159,575 | 7/1979 | Kalmbach | 33/265 |
| 4,162,579 | 7/1979 | James | 33/265 |
| 4,215,484 | 8/1980 | Lauffenburger | 33/265 |
| 4,309,827 | 1/1982 | Larson | 33/265 |
| 4,332,231 | 6/1982 | Napier | 124/24 R |
| 4,377,152 | 3/1983 | Saunders | 124/87 |
| 4,452,222 | 6/1984 | Quartino et al. | 124/88 |

*Primary Examiner*—Richard R. Stearns

*Attorney, Agent, or Firm*—Luedeka & Neely

[57] ABSTRACT

A bow sight having an elongated arm supporting a front sight forward of the bow and a rear sight between the bow and the bow string is disclosed. The front sight has a plurality of fixed sight members which correspond to various target distances and which, in conjunction with the rear sight, provide the proper elevation of the bow to compensate for vertical drop at the various target distances. The elongated arm terminates forward of the bow string so that the bow string does not contact the arm. The arm has a rounded engagement surface and serves as a cable guard for holding the cable away from the plane of movement of the bow string.

15 Claims, 5 Drawing Figures

BOW SIGHT

This invention relates generally to archery and more particularly relates to a bow sight for use in hunting wild game.

Many types of sighting devices have been developed for use with a bow and arrow. The most accurate of such sighting devices have both a front and rear sight and are operable to compensate for different amounts of vertical drop which occur when the targets are at different distances. In some of such sighting devices, a sight member for a certain distance must be selected and moved into an operative position by altering or adjusting one of the front or rear sights. When each shot is fired at a different distance, such as in hunting, manual manipulation of the bow sight is required before the archer is able to take aim. Since a hunter often only has a few seconds to take aim and shoot before his quarry flees, he may consume the time needed to take proper aim when adjusting his bow sight and may consequently miss his mark.

Another problem with many known bow sights is that the rear sight member is positioned behind the bow string. In such devices, the rear sight is too close to the hunter's eye and the distance between the front and rear sights is too great. Consequently, the rear sight member is too far out of focus in the hunter's eye to properly align the members to sight on the target.

An additional problem of many known sighting devices is that they are not particularly suited for compound bows having cables which may interfere with the sighting device.

It is accordingly an object of the present invention to provide a bow sight for use with a compound bow for hunting wild game. It is a further object to provide a bow sight having front and rear sights which do not require manual adjustments to aim at targets at varying distances. It is a further object to provide an extremely accurate bow sight which is usable with different types of bows. It is another object to provide a bow sight for a compound bow having a cable guard.

Other objects and advantages of the present invention will become known by reference to the following description and accompanying drawings in which.

Generally, the bow sight of the present invention includes an elongated arm for attachment to the bow above and adjacent to the arrow rest. The elongated arm has an attachment portion for attaching the arm to the bow, a forwardly extending portion for extending outwardly from the front of the bow, and a rearwardly extending portion for extending outwardly from the rear of the bow. The rearwardly extending portion is for being in a plane generally parallel to the plane of movement of the bow string and that plane is laterally displaced toward the sight window in relation to the attachment portion. The rearwardly extending portion also has an engagement surface for contacting the cable and holding the cable away from the plane of the bow string. The rearwardly extending portion terminates at an end forward of the bow string. The front sight is supported by a front sight support which is attached to the forwardly extending portion of the arm. The rear sight is supported by a rear sight support attached to the rearwardly extending portion of the arm between the bow and the end of the rearwardly extending portion of the elongated arm. The rear sight support is spaced apart from the engagement surface so that the rear sight does not interfere with the movement of the cable when the bow is in use.

Figure 1:
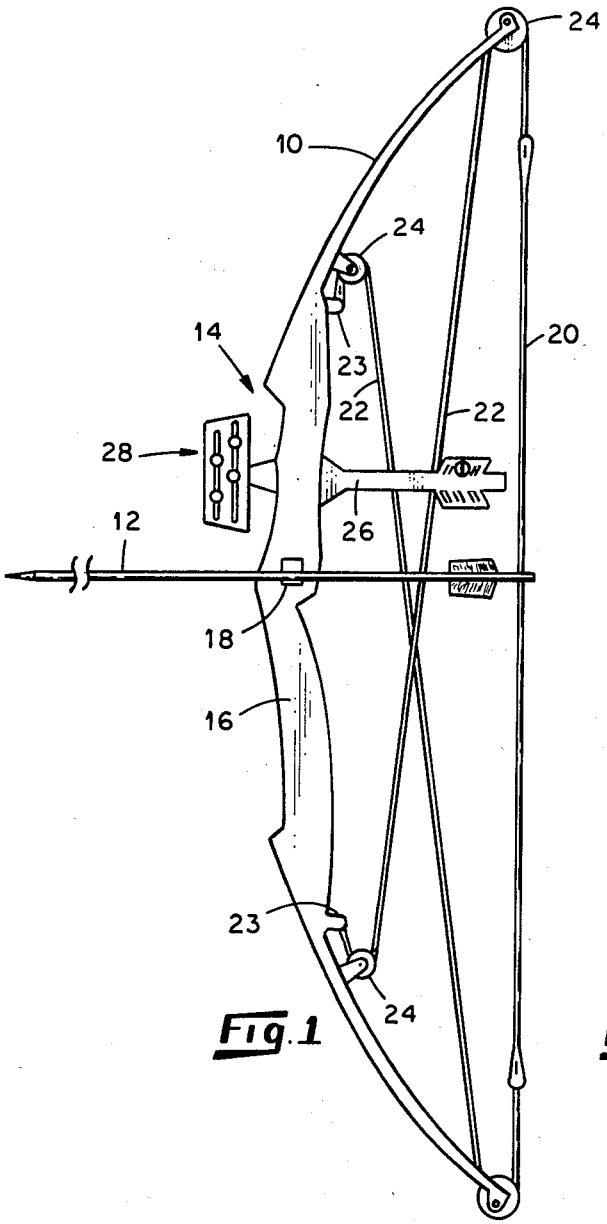
FIG. 1 is a side view of a compound bow attached to which is one form of the bow sight of the present invention.
Figure 2:
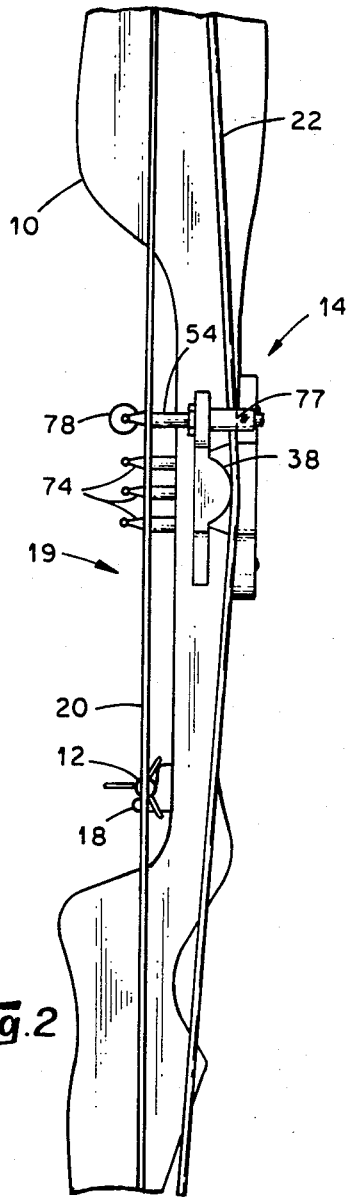
FIG. 2 is an enlarged fragmentary rear view of the compound bow and bow sight of FIG. 1.

Referring now to the drawings in which like reference characters designate like or corresponding parts throughout the several views, there is shown in FIG. 1 a bow 10 and an arrow 12 incorporating one form of the bow sight 14 of the present invention. The bow 10 includes a handle 16, arrow rest 18, and bow string 20. As shown in FIG. 2, the bow also includes a sight window 19 which provides a passage for the arrow 12 and permits sighting. The bow 10 depicted is a compound bow and includes cables 22 having fixed ends 23 connected to the bow 10. The cables 22 are connected to the bow string 20 through pulleys 24 in a manner as is well known in the art. The bowstring 20, when drawn back and released, moves generally in a generally vertical plane which hereinafter is referred to as the plane of movement of the bowstring.

Referring to FIGS. 1 and 2, the bow sight 14 includes an elongated arm 26 which is attached side of the bow opposite the sight window 19 above and adjacent to the arrow rest 18. The bowsight 14 is attached to the bow 10 so the elongated arm 26 is generally parallel to the line of flight of the arrow 12. The elongated arm 26 supports a front sight support 28 and a rear sight support 30.

Figure 5:
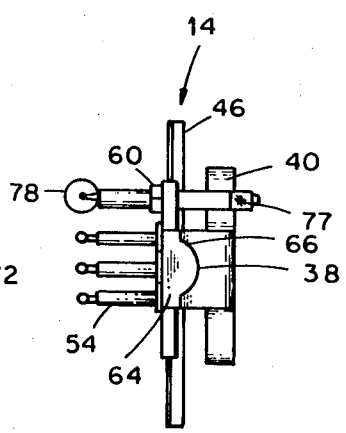
FIG. 5 is an end view of the bow sight of the present invention.
Figure 4:
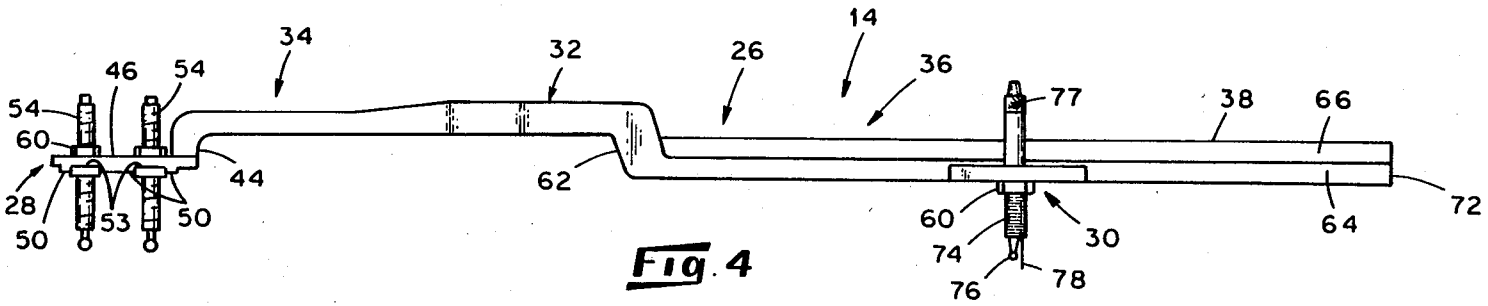
FIG. 4 is a top view of the bow sight of the present invention.
Figure 3:
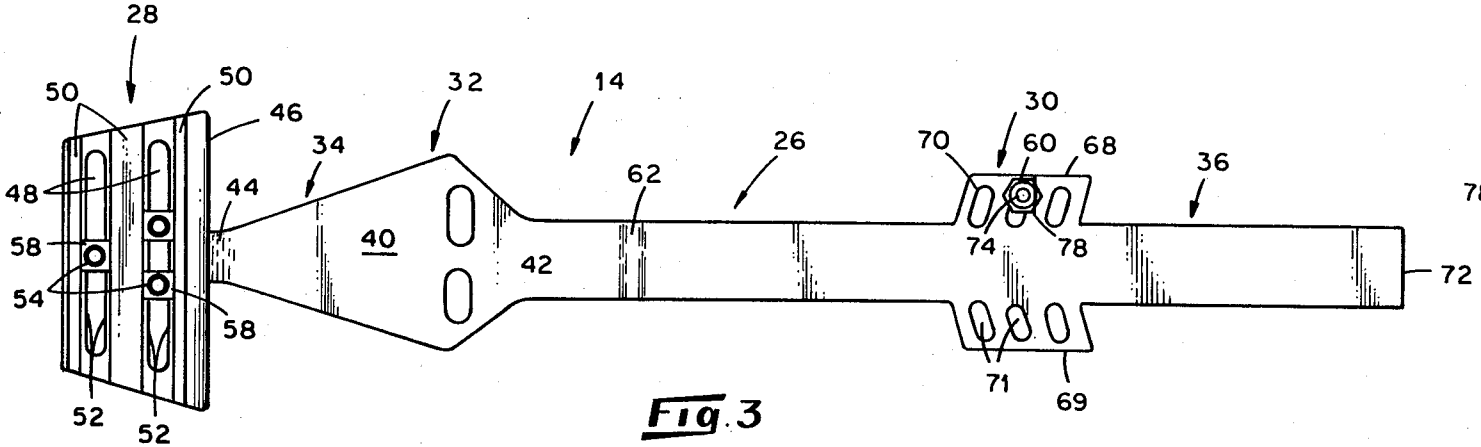
FIG. 3 is a side view of one form of the bow sight of the present invention.

As shown most clearly in FIGS. 3, 4 and 5 showing the bowsight 14 separately, the elongated arm 26 includes an attachment portion 32 for attaching the arm 26 to the bow. A forwardly extending portion 34 extends from the attachment portion 32 and extends outwardly from the front of the bow 10 when the bow sight 14 is attached to the bow. The bow sight 14 also includes a rearwardly extending portion extending from the attachment portion 32 which extends outwardly from the rear of the bow 10 when the bow sight 14 is attached to the bow. As shown in FIGS. 2 and 5, the rearwardly extending portion 36 is laterally displaced toward the sight window 19 from the attachment portion 32 and the rearwardly extending portion 36 is in a plane generally parallel to the plane of movement of the bow string when the bow sight 14 is attached to the bow 10. As is also shown in FIGS. 2 and 5, the rearwardly extending portion 36 has an engagement surface 38 for contacting the cable 22 and holding the cable 22 away from the plane of movement of the bow string 20. The bow sight 14 thus serves as a cable guard.

As shown in FIGS. 3 and 4, the elongated arm 26 and the front sight support and the rear sight support are preferably formed as a unitary member cast from a lightweight metal such as aluminum or an aluminum alloy. Other materials may be used which are sufficiently rigid for the bowsight 14 to operate as a cable guard. As shown, the attachment portion 32 of the arm 26 is an attachment plate 40 having two aligned and vertically oriented attachment slots 42. The attachment plate 40 is preferably widest in the area of the attachment slots 42 and tapers as it extends forwardly and also tapers as it extends rearwardly. The forward portion of the attachment plate 40 provides the forwardly extending portion 34 of the arm 26. At the forward end of the attachment plate 40, a front neck 44 extends generally at a right angle toward the sight window 19 from the attachment plate 40. The front neck 44 is connected to the front sight support 28 which is disposed in a plane generally parallel to the plane of movement of the bowstring 20 and is laterally displaced toward the sight window 19 from the attachment plate 40.

As shown in FIGS. 3 and 4, the front sight support is appropriately provided by a front sight plate 46. The front sight plate 46 includes two front sight slots 48 formed in the plate 46 which extend generally vertically. Preferably the front sight plate 46 has a trapezoidal configuration when viewed from the side as in FIG. 3 with the long base facing rearwardly and the short base facing forwardly. Also as shown in FIGS. 3 and 4, front sight ribs 50 are formed on the side of the front sight plate 46 facing the sight window 19. As shown in FIGS. 3 and 4, there are three front sight ribs in the embodiment depicted. The front sight ribs 50 extend generally vertically and are spaced apart from the front sight slots 48 a short distance so as to form ledges 52. The ribs 50 and ledges 52 together form two vertically oriented channels 53 on the surface of the plate 46 with the slots 48 being formed in the bottoms of the channels 53.

A plurality of sight pins 54 each terminating with a front sight bead 56 are provided on the front sight support 28. The sight pins 54 are threaded and are attached to the front sight plate 46 by means of square nuts 58 on the ribbed side of the front sight plate 46 and by hex nuts 60 on the opposite side. The square nuts 58 are appropriately dimensioned so that they fit into the channels 53 and rest on the ledges 52 on the front sight plate 46 and so that when the square nuts 58 are resting on the ledges 52 the ribs 50 contact the nuts 58 and prevent them from rotating. The front sight pins 54 may be adjusted vertically and horizontally by loosening the nuts 58 and 60 and appropriately turning the sight pins.

The front sight plate 46 and the forwardly extending portion 34 of the arm 26 are appropriately dimensioned so that the front sight beads 56 are between three and five inches from the bow 10.

As the attachment plate 40 tapers rearwardly, it connects to the rearwardly extending portion 36 of the arm 26. At a distance rearward of the attachment plate 40 and forward of where the cables 22 cross the arm 26, a rear neck 62 displaces the remainder of the rearwardly extending portion 34 toward the sight window 19. The remainder of the rearwardly extending portion 36 provides the engagement surface 38 on the side of the rearwardly extending portion facing away from the sight window. The engagement surface 38 preferably maintains the cables 22 about one-half inch from the plane of the bowstring.

As shown in FIGS. 2 and 5 the engagement surface is rounded so that the cables 22 will slide easily over the engagement surface 38. Preferably, the rearwardly extending portion 34 of the arm 26 has a cross-section as shown which may be described as the combination of a bar 64 having a rectangular cross-section with the longer dimension oriented vertically with a half-round bar 66 having a semicircular cross-section centered along the side of the bar facing away from the sight window 19.

The rear sight support 30 is provided by upper and lower rear sight tabs 68 and 69, respectively, which extend vertically from the bar 64 of the rearwardly extending portion 36. The upper sight tab 68 extends upwardly from the bar 64 and the lower sight tab 69 extends downwardly from the bar 64. The tabs 68 and 69 have three generally vertically oriented rear sight slots 70. The tabs 68 and 69 are positioned on the rearwardly extending portion 36 between the bow 10 and the bowstring 20 so that the slots 70 are between five and eight inches from the bow 10. Each of the rear sight tabs 68 is preferably shaped as a parallelogram with the angled sides slanting rearwardly and with the slots angled slightly rearwardly. The tabs 68 and 69 and the slots 70 in conjunction with the rearwardly extending portion preferably have the appearance of the feathers and nocked end of an arrow 12.

The rearwardly extending portion 36 terminates at an end 72 which is short enough so that it will not contact the bow string 20. The bowsight is conviently provided with the rearwardly extending portion 36 being longer than needed which may be cut to fit the bow 10 as needed.

The rear sight is provided by a threaded rear sight pin 74 which is inserted into a selected rear sight slot 70. The rear sight pin 74 has a smaller rear sight bead 36 than the front sight bead 56 so that the rear sight bead 76 will eclipse a selected front sight bead 56 with just a small portion of the front sight bead 56 showing. The rear sight pin 74 is secured in a rear sight slot 70 by means of a hex nut 60 and a knurled knob 77 for quick adjustment both vertically and horizontally. Also, the rear sight bead 76 is encircled by a sighting ring 78 which is operable to aid a hunter in aligning the front and rear sight beads quickly.

The spacing between the front sight beads 56 and the rear sight bead 76 is between eight and thirteen inches and preferably is between ten and eleven inches.

In use, the bow sight 14 of the present invention is attached to the bow 10 by means of screws, bolts or other such fasteners which are insertable through the slots 42 to attach the bow sight 14 to the bow 10. Since the slots are elongated, the bow sight may be adjusted vertically and may be pivoted slightly to align the elongated arm 26 to be generally in line of flight of the arrow. The cable 22 is placed on the engagement surface 38 so that the engagement surface 38 will maintain the cable away from the plane of the bow string 20. The upper and lower tabs, 68 and 69, respectively, are spaced apart from the engagement surface 38 and thus will not interfere with the cables 22. If the knurled knob 77 contacts the cables 22 in certain of the slots 70, it is necessary to move the rear sight pin 74 to another of the slots 70 where the cables 22 do not contact the knurled knob 77. Once the bow sight 14 is appropriately secured to the bow 10, the three front sight pins 54 and the rear sight pin 74 are appropriately adjusted vertically and horizontally so that the alignment of the rear sight bead 76 with a selected front sight bead 56 will incline the bow at a proper angle to compensate for vertical drop of the arrow through the distance to the target and will sight directly on the target laterally. The front sight beads 56 are preferably color-coded so that the hunter knows which sight bead corresponds to a selected target distance.

When hunting with a bow sight 14 according to the present invention, a hunter selects the front sight bead 54 which most closely corresponds to the distance to his quarry and sights first by aligning the sight ring 78 around the selected sight pin 54 and with the quarry. The hunter then aligns the rear sight pin 74 with the front sight pin 54 so that just a small portion of the front sight pin 54 is visible while keeping the front sight pin 54 in alignment with the quarry.

The bow sight of the present invention provides an easy to use and extremely accurate sighting device for a compound bow for compensating for various target distances. A spacing between the front and rear sights with the rear sight between the bow and the bowstring is optimal for ease of use and accuracy and the bowsight may be used with many different compound bows. Moreover, the bow sight of the present invention provides a cable guard as an intregal part of the bow sight which, by holding the cable away from the plane of the bow string, also provides for further increases in accuracy. The elongated arm 26 terminates at an end 72 which is spaced apart from the bow string so that the arm 26 does not contact and interfere with the bow string 20. In addition, the rear sight support 30 is spaced apart from the engagement surface 38 so that the rear sight does not interfere with the cables. The front sight pins 54 are quickly adjustable. Only the hex nut 60 need be loosened and retightened since the square nuts 58 fit in the slots and do not turn when the pin or the hex nut is rotated. The rear sight pin is easily and quickly adjusted with the knurled knob 77.

Although a particular embodiment of the present invention has been described in the foregoing detailed description, it will be understood that the invention is capable of numerous modifications without departing from the spirit of the invention.

What is claimed is:

1. A bow sight for a compound bow having a sight window, a bow string, cables and an arrow rest, comprising:

an elongated arm for attachment to the bow above and adjacent to the arrow rest on the side of the bow opposite the sight window, said elongated arm having an attachment portion for attaching said arm to the bow, a forwardly extending portion for extending outwardly from the front of the bow, and a rearwardly extending portion for extending outwardly from the rear of the bow and for being in a plane generally parallel to the plane of movement of the bow string, said rearwardly extending portion being laterally displaced toward the sight window from said attachment portion, said rearwardly extending portion having an engagement surface for contacting the cable and holding the cable away from the plane of the bow string, said rearwardly extending portion terminating at an end forward of the bow string;

means for fastening said attachment portion to the bow;

front sight means;

a front sight support attached to said forwardly extending portion of said arm for supporting said front sight means;

rear sight means;

a rear sight support attached to said rearwardly extending portion of said arm between said bow and said end of said rearwardly extending portion, said rear sight support being spaced apart from said engagement surface, whereby said rear sight support does not interfere with the movement of the cables when the bow is in use.

2. The bow sight of claim 1 wherein said front sight means comprises a plurality of fixed front sight members for selected use in conjunction with said rear sight means, each of said plurality of sight members corresponding to a target distance.

3. The bow sight of claim 2 wherein said plurality of fixed front sight members comprise a plurality of sight pins each having a sight bead.

4. The bow sight of claim 3 wherein said front sight support comprises a vertically oriented plate having two vertically disposed slots and means for adjustably securing said plurality of sight pins in said slots, said slots and said securing means being operable to receive said sight pins and to permit vertical and horizontal adjustment of said plurality of said sight pins.

5. The bow sight of claim 4 further comprising ribs on the side of said sight plate adjacent to the sight window extending parallel to said slots and being spaced apart from said slots.

6. The bow sight of claim 5 wherein said means for securing said sight pins and said slots comprises threads on said sight pins and threaded nuts of sufficient size to span the distance across said slots and to be prevented from rotating by said ribs on said plate.

7. The bow sight of claim 6 wherein said sight pins are spaced apart from the bow by between about three and about five inches.

8. The bow sight of claim 1 wherein said rear sight means comprises a sight pin having a sight bead.

9. The bow sight of claim 8 wherein said rear sight support comprises a generally vertically oriented tab extending from said elongated arm for supporting said sight pin, said tab being disposed in a generally vertical plane laterally displaced away from said engagement surface so that said tab does not interfere with the movement of said cables.

10. The bow sight of claim 8 wherein said rear sight support comprises an upper tab extending upwardly from said arm and having a generally vertically oriented upper tab slot and a lower tab extending downwardly from said arm and having a generally vertically oriented lower tab slot and means for selectively and adjustably securing said rear sight pin in one of said slots, said upper and lower slots and said adjustable securing means being operable to selectively receive and permit vertical and horizontal adjustment of said rear sight pin, said upper and lower tabs being disposed in a generally common plane laterally displaced away from said engagement surface so that said rear sight support does not interfere with the movement of the cables.

11. The bow sight of claim 10 wherein said rear sight pin is between about eight and about thirteen inches from the bow.

12. The bow sight of claim 1 wherein said engagement surface has a rounded configuration so that said cables readily slide on said engagement surface when the bow is in use.

13. The bow sight of claim 12 wherein said attachment portion comprises a generally vertical plate disposed in a plane generally parallel to the plane of movement of the bowstring.

14. The bow sight of claim 13 wherein said means for fastening said attachment portion to the bow comprises a generally vertically oriented slot in said plate and means adapted to fit in said slot for securing said plate to the bow.

15. The bow sight of claim 1 wherein the spacing between said front sight means and said rear sight means is between about eight and about thirteen inches.

* * * * *